United States Patent [19]

Kreeft et al.

[11] 3,939,537

[45] Feb. 24, 1976

[54] APPARATUS FOR LONGITUDINALLY COMPRESSING TEXTILE MATERIAL

[75] Inventors: John Kreeft, Wykoff; Peter Stanislaw, Stockhom; Rudolph G. Gulbrandsen, Demarest, all of N.J.

[73] Assignee: Morrison Machine Co., Paterson, N.J.

[22] Filed: Oct. 24, 1973

[21] Appl. No.: 409,052

[52] U.S. Cl. ..... 26/18.6
[51] Int. Cl.[2] ..... D06C 21/00
[58] Field of Search ..... 26/18.6

[56] References Cited

UNITED STATES PATENTS

| | | | |
|---|---|---|---|
| 2,262,268 | 11/1941 | Chatfield | 26/18.6 |
| 2,522,663 | 9/1950 | Chatfield | 26/18.6 |
| 3,007,223 | 11/1961 | Wehrmann | 26/18.6 |
| 3,195,210 | 7/1965 | Wehrmann | 26/18.6 |

FOREIGN PATENTS OR APPLICATIONS

| | | | |
|---|---|---|---|
| 863,979 | 3/1961 | United Kingdom | 26/18.6 |
| 955,363 | 4/1964 | United Kingdom | 26/18.6 |

OTHER PUBLICATIONS

Compressive Shrinking Ranges for Low Cost Production, Butterworth Manufacturing, Bulletin CSR–10–73.

*Primary Examiner*—Robert R. Mackey
*Attorney, Agent, or Firm*—Lerner, David, Littenberg & Samuel

[57] ABSTRACT

An apparatus is disclosed for longitudinally compressing materials such as knit fabrics. The apparatus includes a frame with the frame having first and second spaced apart side walls. First and second drive rollers are supported between the side walls and first and second idler roller assemblies are also supported between the side walls. A first endless belt passes around the first drive roller and the first idler roller assembly and a second endless belt passes around the second drive roller and the second idler roller assembly. A fabric passing between the endless belts is appropriately longitudinally compressed thereby. The second side wall has an opening therethrough and closure means moveable between a closed and open position with respect to the opening. The first and second drive rollers and the first and second idler roller assemblies are cantilevered on the first wall when the closure means is moved to its open position and, in this manner, the endless belts can be easily removed from about the drive rollers and idler roller assemblies without disassembling the entire frame of the machine. As a further feature, first tension roller means engage the first endless belt, and second tension roller means engage the second endless belt. First support means are carried on the inner surface of the first side wall for adjustably carrying one end of the first tension roller, and second support means are rotatably carried on the inner surface of the second side wall for adjustably carrying the other end of the first tension roller means. The second tension roller means is similarly supported. Means are provided to rotate the second support means and essentially guide the endless belts back to their intended position on the respective rollers in the event such belts tend to move laterally on their rollers.

37 Claims, 15 Drawing Figures

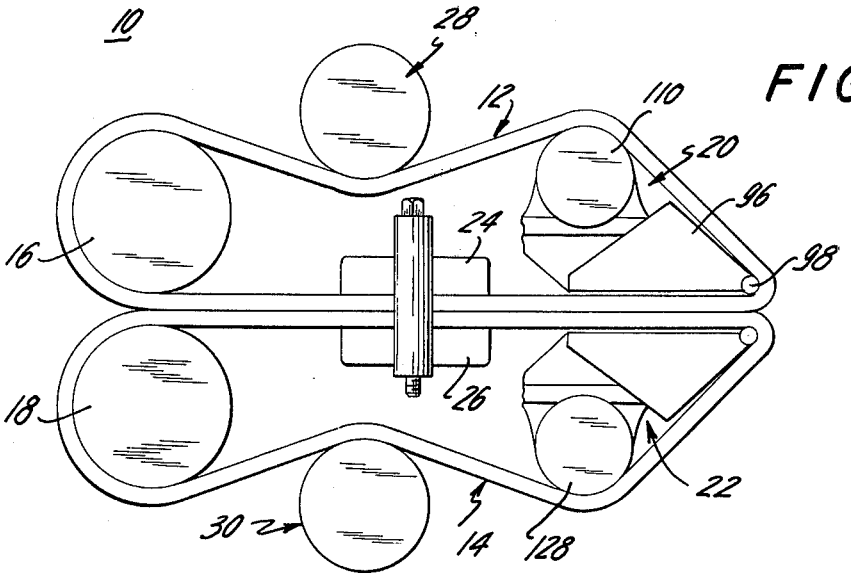
FIG. 1
FIG. 8
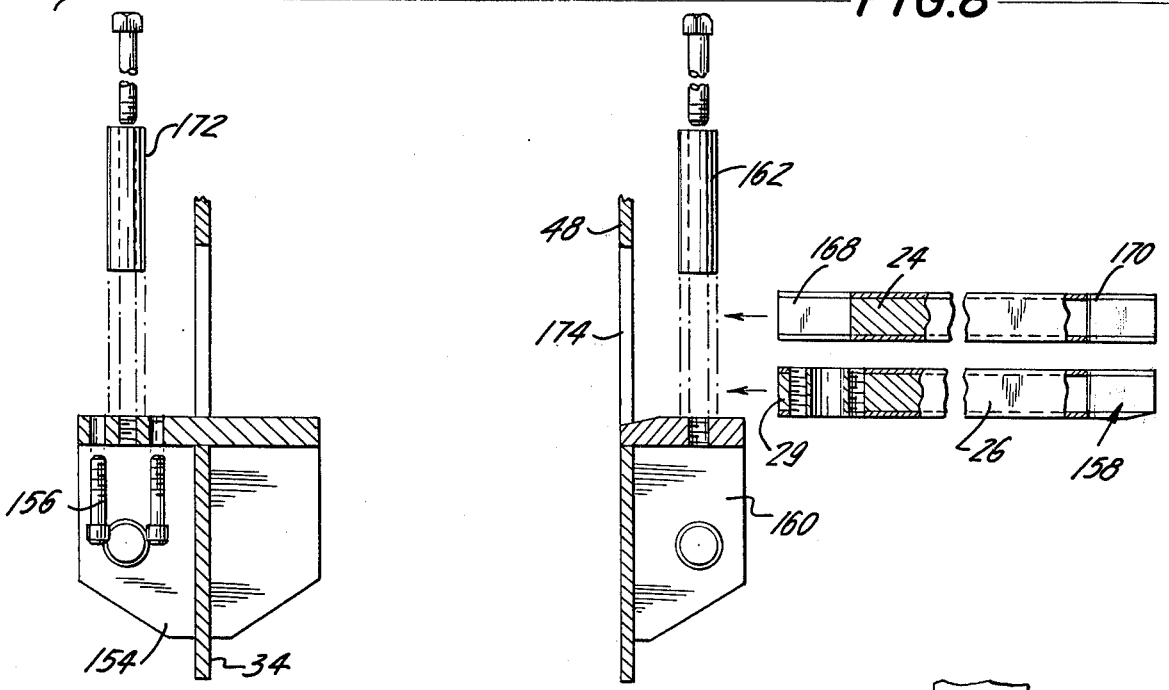
FIG. 10
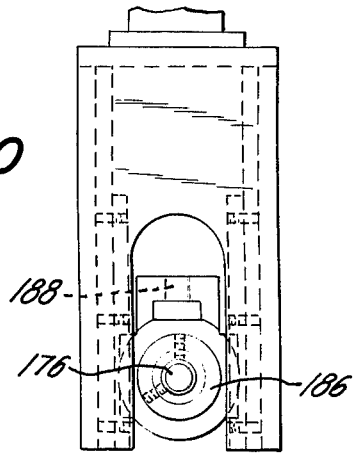

FIG. 11
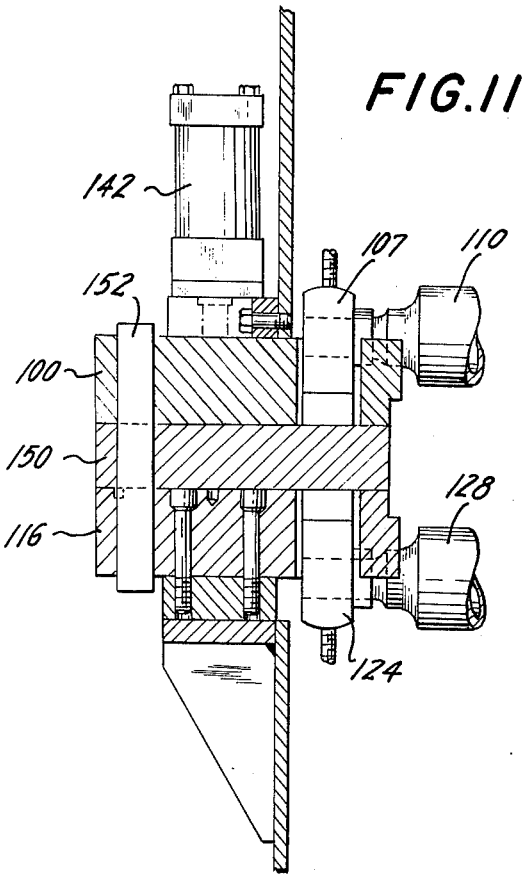
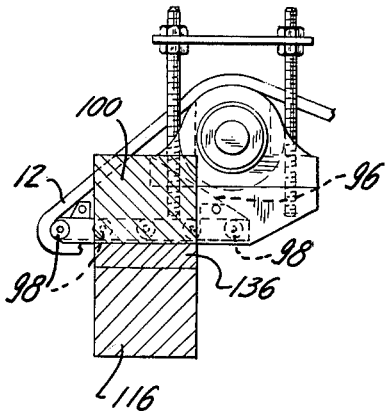
FIG. 12
FIG. 13
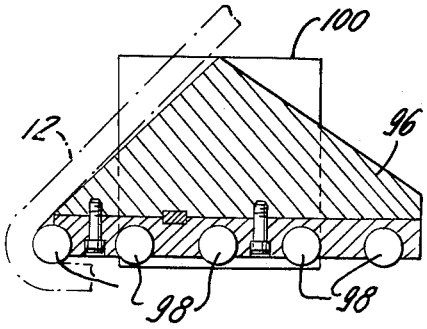
FIG. 14
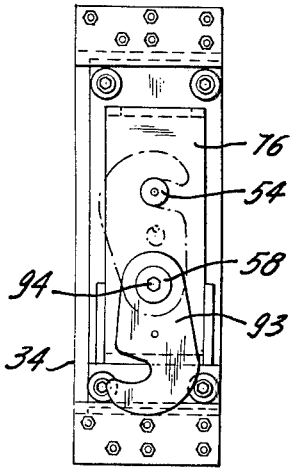

APPARATUS FOR LONGITUDINALLY COMPRESSING TEXTILE MATERIAL

FIELD OF THE INVENTION

This invention relates to an apparatus for longitudinally compressing materials such as textile materials and, more particularly, to such a compressing apparatus which greatly facilitates the removal and changing of the endless blankets used in conjunction with such apparatus.

BACKGROUND OF THE INVENTION

In the art of preshrinking textile materials, it is known to pass the material to be treated between a pair of endless belts, commonly referred to as blankets. The blankets are typically constructed of rubber or rubber-like material, with each such blanket being guided by a plurality of rollers. Cooperating tension rollers are employed to properly tension the blankets such that the blankets compress the fibers of the textile material passing therebetween toward one another to thereby preshrink the textile material and thus diminish possible shrinkage which might otherwise occur during subsequent washing. One such process known in the industry which employs such apparatus is known as the Sanforizing Process.

One problem which has constantly plagued the users of such compressing apparatus relates to the difficulty of removing and changing the rather heavy, closely spaced endless blankets which constitute the heart of the process. Customarily, the various rollers which support and guide the blankets are supported at their ends on the side walls of a frame assembly. When it is desired to remove the blankets, it is necessary to disassemble the frame such that the blankets can be removed from the supporting rollers which necessarily are positioned inside of the confines of the blankets. Unfortunately, this process of disassembling the frame so that the blankets can be withdrawn from the rollers is extremely complex, necessarily time consuming and results in substantial "down time" adversely effecting maximum utilization of the equipment.

Another unnecessarily complex arrangement prevalent in prior art machinery of the type hereinvolved relates to the apparatus for tensioning and guiding the aforementioned blankets. Traditionally, one set of adjustable rollers contacts the blankets and may be preselectively positioned to properly bias the blankets and establish the desired tension thereon. A second set of adjustable rollers is also provided to selectively raise or lower one side of the blankets and thereby reposition the blankets at their proper central location with respect to the width of the apparatus in the event that the blankets begin to "creep" toward one side or the other. The necessity of two sets of adjustable rollers to perform these two functions necessarily increases the complexity of the overall apparatus, not only adding to its cost, but also increasing the probability of eventual mechanical malfunction.

SUMMARY OF THE INVENTION

In contradistinction to the prior art, the instant invention provides a longitudinally compressing apparatus of the aforedescribed type, in which virtually all of the driving, guiding and supporting elements which are located within the confines of the endless belts thereof are capable of being cantilevered from one side of the frame assembly when it is desired to remove the blankets from their operative positions. As will be described in greater detail, when an operator wishes to remove the endless belts, he merely opens a special function door which has been provided in one side of the frame to thereby expose the cantilevered ends of the blanket supportive elements. In this manner, the endless blankets can be simply slid off the now free ends of their guiding rollers and replaced with relative ease. Thereafter, the aforementioned door is closed and all branket supporting elements are once again firmly supported in operative position on opposite ends thereof. Needless to say, the replacement operation is relatively simple, and substantially quicker when compared to the prior art.

In accordance with another aspect of the instant invention, the aforementioned tensioning and guiding function previously performed by two sets of adjustable rollers is now performed by novel combination tensioning and guiding roller assemblies which have the dual capability of vertical movement to effect the desired tension on the endless blankets and preselected rotary motion on one end thereof for directing the blankets toward their properly centered position.

Accordingly, it is an object of the instant invention to provide an apparatus for longitudinally compressing material which includes a plurality of blanket supporting elements capable of being cantilevered from one side of the frame thereof when it is desirable to remove the endless blankets therefrom.

Another object of the invention invention is to provide an apparatus for longitudinally compressing material which includes novel combination tensioning and guide roller assemblies which perform the dual function of establishing the proper tension on the endless blankets employed therein and properly guiding the endless blankets toward their centered position.

Other objects of the instant invention may be had by referring to the following specification and drawings.

BRIEF DESCRIPTION OF THE SEVERAL VIEWS OF THE DRAWINGS

FIG. 1 is a left side elevation of the apparatus of the instant invention greatly simplified to illustrate the major blanket guiding and support assemblies employed therein.

FIG. 8 is an exploded view, partly in section, of the apparatus shown in FIG. 7.

FIG. 10 is a view of a portion of the apparatus shown in FIG. 6.

FIG. 11 is an elevation illustrating a portion of the apparatus shown in FIG. 4 in its blanket removal position.

FIG. 12 is a right side elevation of a portion of the apparatus shown in FIG. 4 taken along the lines 12—12 thereof.

FIG. 13 is an enlarged view of a portion of the wedge bar assemblies of the instant invention.

FIG. 14 is an enlarged right side elevation of a portion of the apparatus shown in FIG. 2.

DETAILED DESCRIPTION

Figure 2:
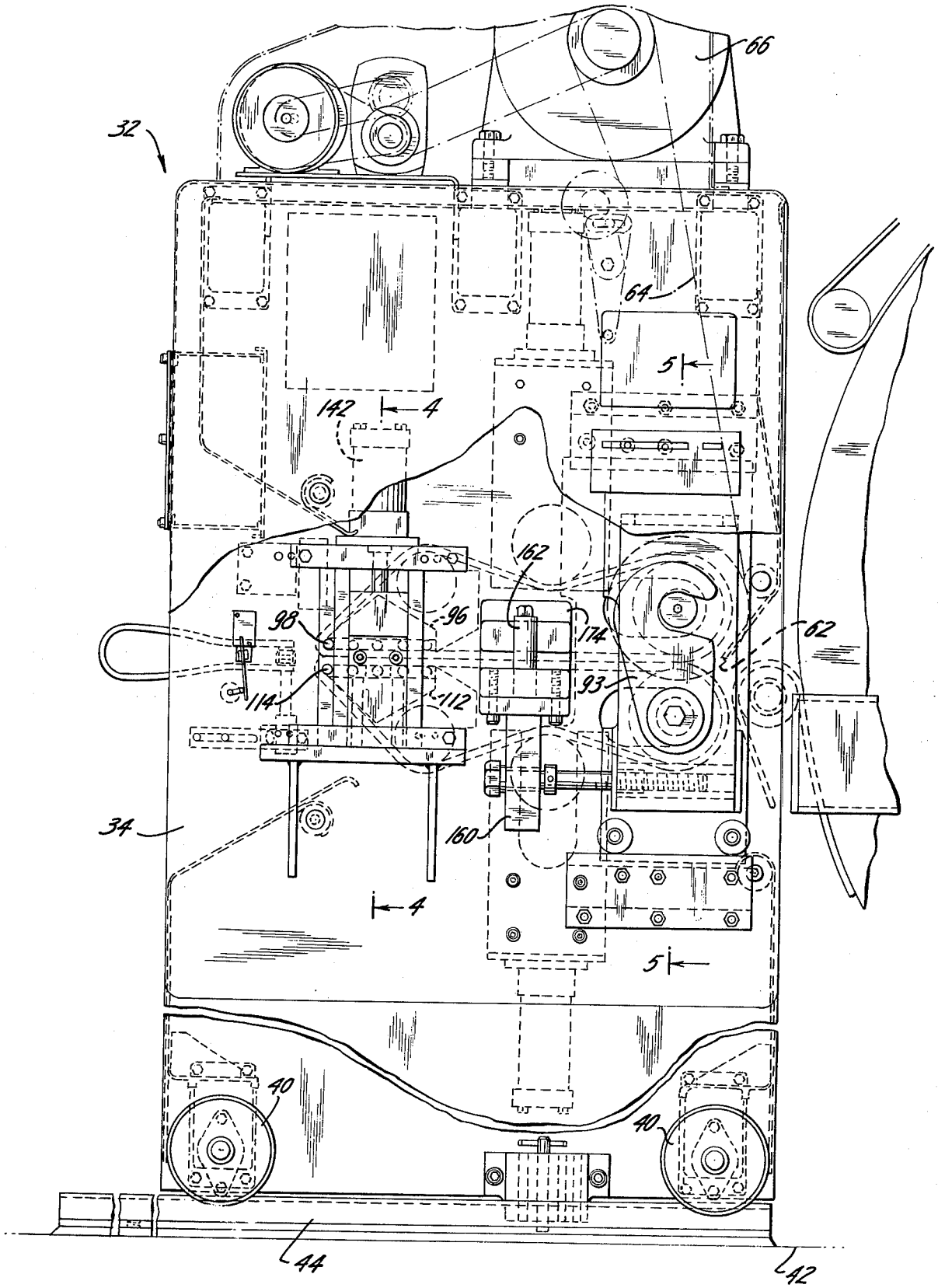
FIG. 2 is a right side elevation of the apparatus of the instant invention.

Turning to the figures, wherein like numerals designate like elements, there is illustrated in FIG. 1 a simplified showing of the compressing apparatus 10 of the instant invention. As well known, and as described previously, such apparatus includes a pair of endless belts 12 and 14, commonly designated blankets, between which textile material is passed to compress and, thereby, preshrink the fabric. Located within the confines of the endless belts 12 and 14 are drive rollers 16 and 18, respectively, idler roller assemblies 20 and 22, respectively, and guide bars 24 and 26, respectively. Positioned outside of the blankets 12 and 14, but in preselective engagement therewith are tension rollers assemblies 28 and 30, respectively. As can be appreciated, by raising or lowering the tension roller assemblies 28 and 30, the amount of tension impressed on the blankets 12 and 14 may be varied. Also, to be described in greater detail, it should be noted that by laterally moving one end of the tension roller assemblies 28 and/or 30 with respect to the opposite end thereof, the blankets 12 and/or 14 may be centered with respect to their supporting rollers, i.e., into or out of the plane of the paper upon which FIG. 1 is drawn. The various components described with respect to FIG. 1 are supported in a frame in the following manner.

Figure 3:
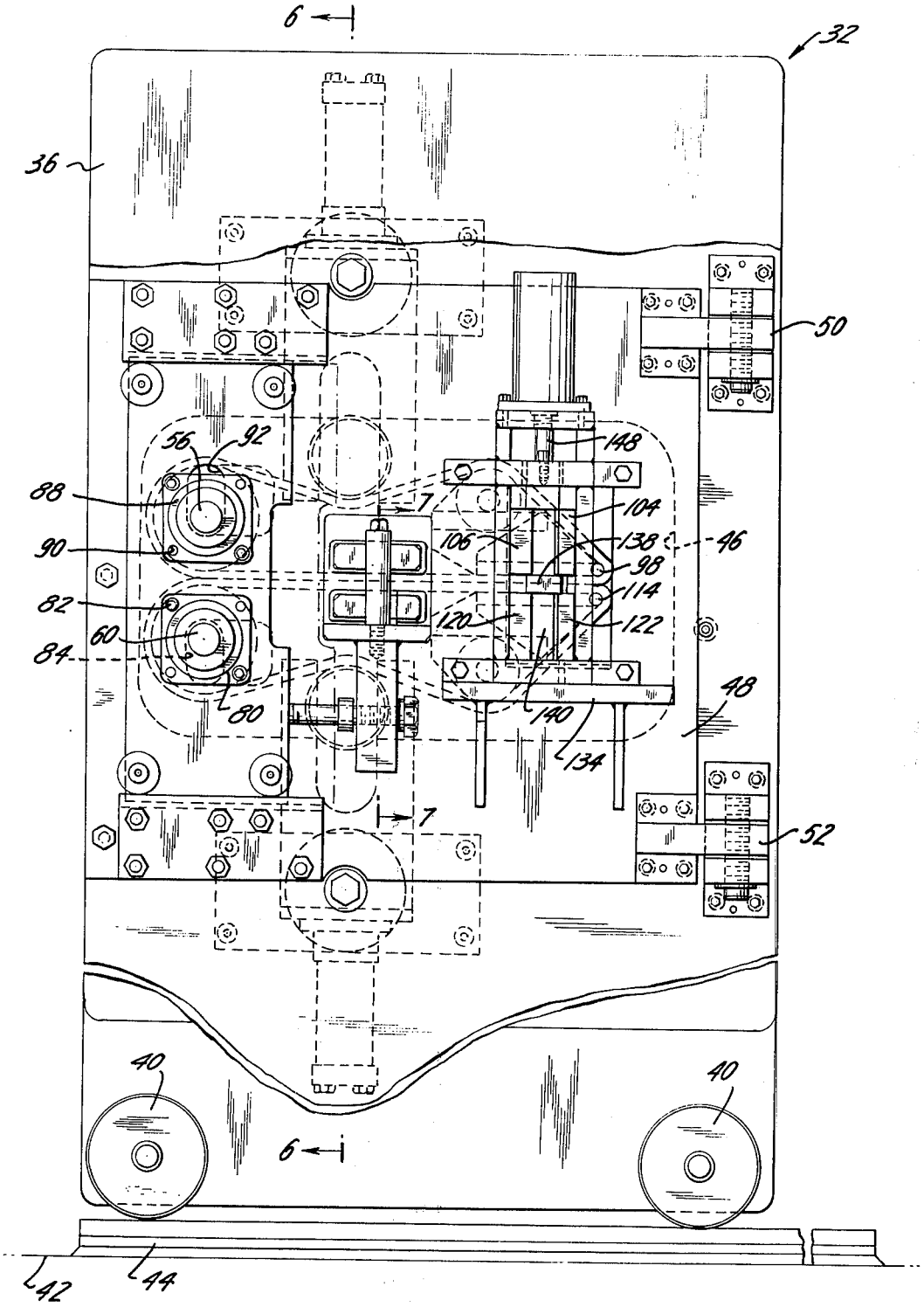
FIG. 3 is a left side elevation of the apparatus of the instant invention.
Figure 5:
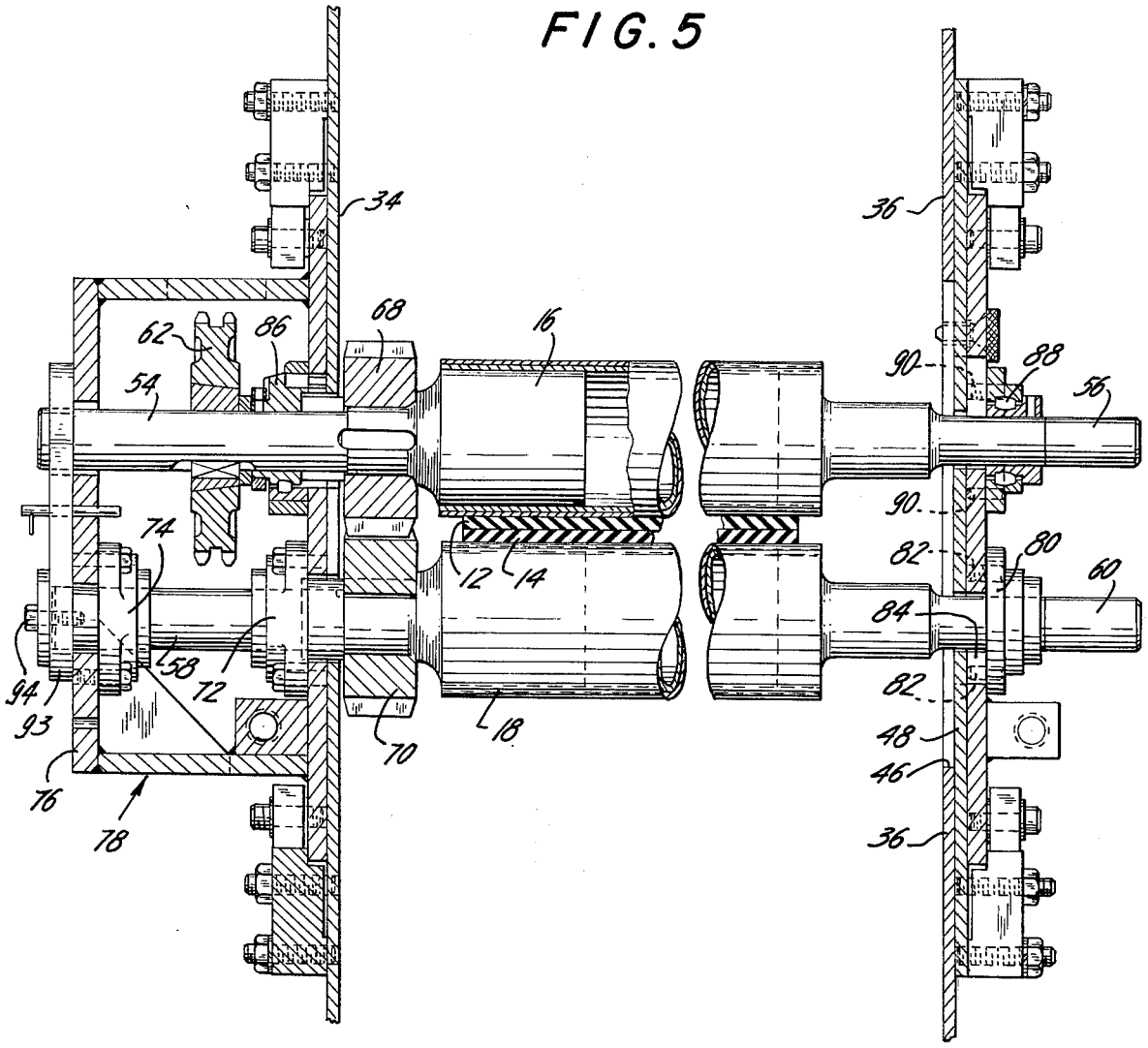
FIG. 5 is an elevation, partly in section, of a portion of the apparatus shown in FIG. 2 and taken along the lines 5—5 thereof.
Figure 6:
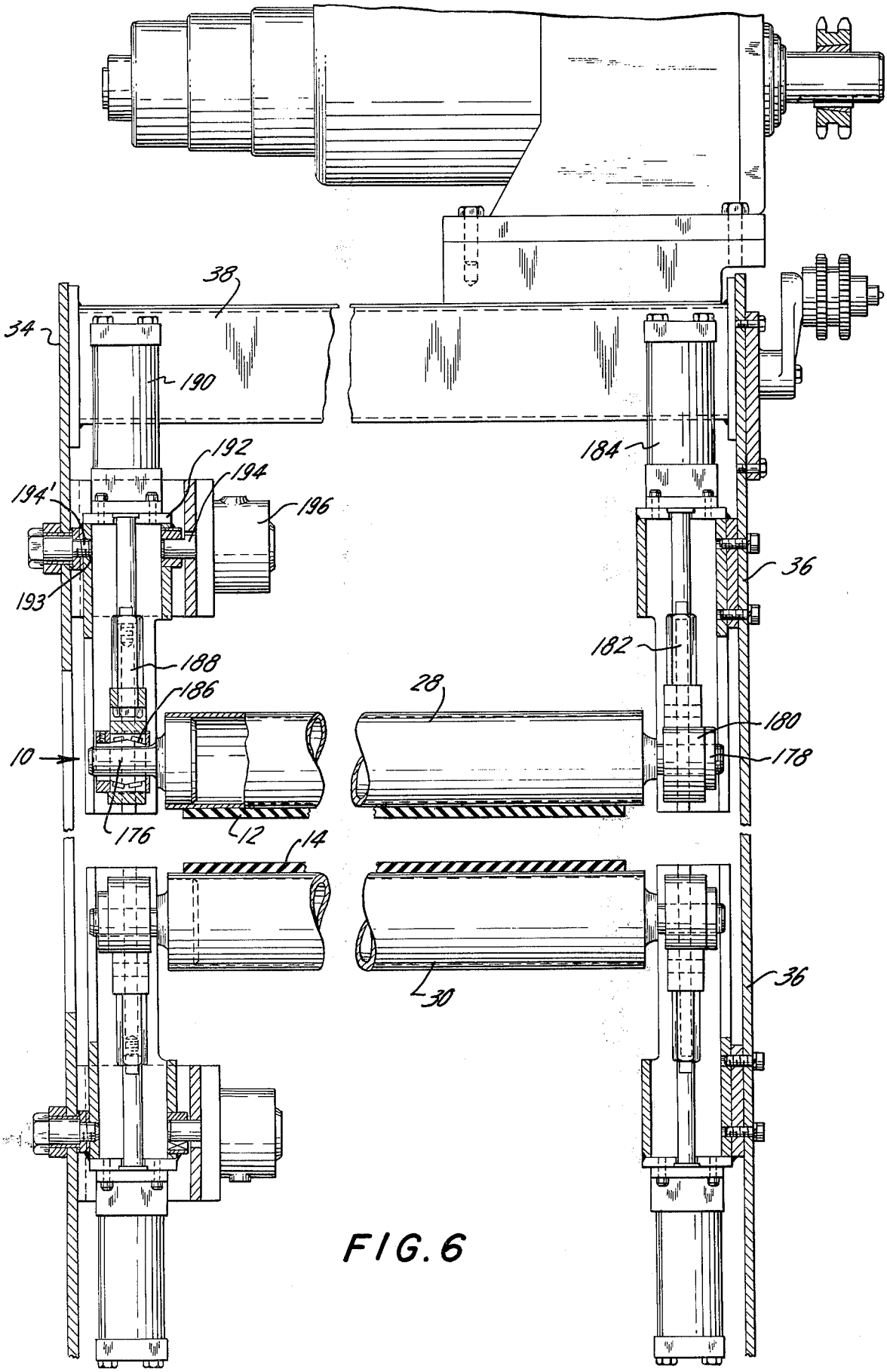
FIG. 6 is a rear elevation, partly in section, of a portion of the apparatus shown in FIG. 3 and taken along the lines 6—6 thereof and illustrating the novel combination tensioning and guiding assemblies hereof.

As best seen in FIGS. 2 and 3, the frame 32 includes first and second side walls 34 and 36, respectively, spaced apart by a plurality of struts, only one of which is shown and designated 38 in FIG. 6. The entire frame 32 is carried by wheels 40 by which the entire frame may be moved along a surface 42, preferably with the aid of tracks 44. For purposes to be further described, second side wall 36 includes a substantial opening 46 therethrough (see FIGS. 4 and 5) normally closed during the operation of the apparatus by a door 48 pivotally hinged to side wall 36 by hinge assemblies 50 and 52.

Considering FIG. 3 with FIG. 5, it will be seen that the drive rollers 16 and 18 terminate in reduced diameter end portions 54, 56 and 58, 60, respectively. End portion 54 carries sprocket gear 62 which receives a chain drive 64 (FIG. 2) from motor 66, and end portions 54 and 58 have rigidly keyed thereto engaged gears 68 and 70 by which the drive imparted to roller 16 can also be imparted to drive rollers 18.

End portion 58 of drive roller 18 is journaled for rotation in bearings 72 and 74. Bearing 72 is secured to first side wall 34, while bearing 74 is carried by the upstanding portion 76 of a first support bracket 78 rigidly secured to and extending outwardly from side wall 34. End portion 60 of drive roller 18 is journaled for rotation in bearing 80 removably secured to the uppermentioned door 48 by screw-threaded fasteners 82. It should be noted that end portion 60 passes through a downwardly enlarged opening 84 in the door 48, the function of such downwardly enlarged opening 84 to be further explained.

End portion 54 of roller 16 is journaled for rotation in bearing 86 secured to side wall 34. The opposite end 56 of drive roller 16 is journaled for rotation in bearing 88, removably secured to door 48 by screw-threaded fasteners 90. It should be noted that end portion 56 passes through an upwardly enlarged opening 92 in the door 48 for reasons to be further apparent.

It will thus be appreciated that during normal operation of the compressing apparatus hereof, the drive rollers 16 and 18 are supported on opposite ends thereof by bearings 86, 88, and 72, 80, respectively. However, and disregarding for the moment the remaining portions of the apparatus, should it be required to remove the blankets 12 and 14 from about the rollers 16 and 18, one need only remove the bearings 88 and 80 carried by the door 48, and pivotally open the door 48 about its hinges 50 and 52, to thereby expose the free ends 56 and 60 of the rollers 16 and 18 which will now be cantilevered (i.e., supported at one side only) from the first side wall 34 of the frame 32. This may be visually observed in FIG. 15. Of course, once the door is open, with the free ends 56 and 60 cantilevered in their exposed position, it is a relatively simple matter to slide the blankets 12 and 14 off the rollers.

It should be noted that in the cantilevered position, the lower drive roller 18 will be firmly supported at its opposite end 58 thereof by two points of support, namely, the bearing 72 and the bearing 74 secured on the vertical portion 76 of the support bracket 78. To provide a second point of support for cantilevering the upper drive roller 16, a connecting hook 93 (screwed into the end 58 of drive roller 18 as at 94) is rotated 180° from its nonoperative, hanging position to its hook engaging position illustrated in phantom in FIG. 14.

It should be noted, and can be clearly seen in FIG. 5, that the blankets 12 and 14 are in close intimate contact when no fabric is passing therebetween. Furthermore, such blankets, being of heavy rubber-like material, are extremely difficult to remove from the rollers 16 and 18 even when their free ends 56 and 60 are cantilevered in the fashion illustrated in FIG. 15. To facilitate the removal of the blankets, it should be noted that when the bearing 80 is removed from the door 48 (before the door is opened), the weight of the roller 18 causes its free end 60 to drop. However, such downward movement is accommodated by the aforementioned downwardly enlarged opening 84. In like fashion, when the bearing 88 is removed from the door 48, the predetermined length of the hook 93 is chosen such that the free end 56 of the drive roller 16 must be lifted before the hook 93 can be latched in place. Here, again, the aforementioned upwardly enlarged opening 92 in the door 48 accommodates such upward motion. Thus, when the door 48 is finally opened, the downward droop of the roller 18, together with the upward tilt of the roller 16 has the net effect of separating these two rollers and greatly facilitating the removal of the blankets 12 and 14.

Considering FIGS. 3, 4, 12, and 13, it will be seen that idler roller assembly 20 comprises a wedge-shaped bar 96 which carries along its lower surface a plurality of rollers 98. The wedge-shaped bar 96 terminates at one end thereof in an end block 100 and at the other end thereof in a bifurcated end block 102 having legs 104 and 106 (see FIG. 3). End block 100 carries bearing 107, while bifurcated end block 102 carries bearing 108. Bearings 107 and 108 carry main idler roller 110 above wedge block 96.

In like fashion, the second idler roller assembly 22 comprises a wedge-shaped bar 112 which carries a plurality of rollers 114 thereabove. Wedge-shaped bar 112 terminates at its left-most end (as viewed in FIG. 4) in end block 116 and terminates at its opposite end in bifurcated end block 118, including legs 120 and 122 (See FIG. 3). End block 116 carries bearing 124, while bifurcated end block 118 carries bearing 126. Bearings 124 and 126 support main idler roller 128 beneath wedge-shaped bar 112.

Figure 4:
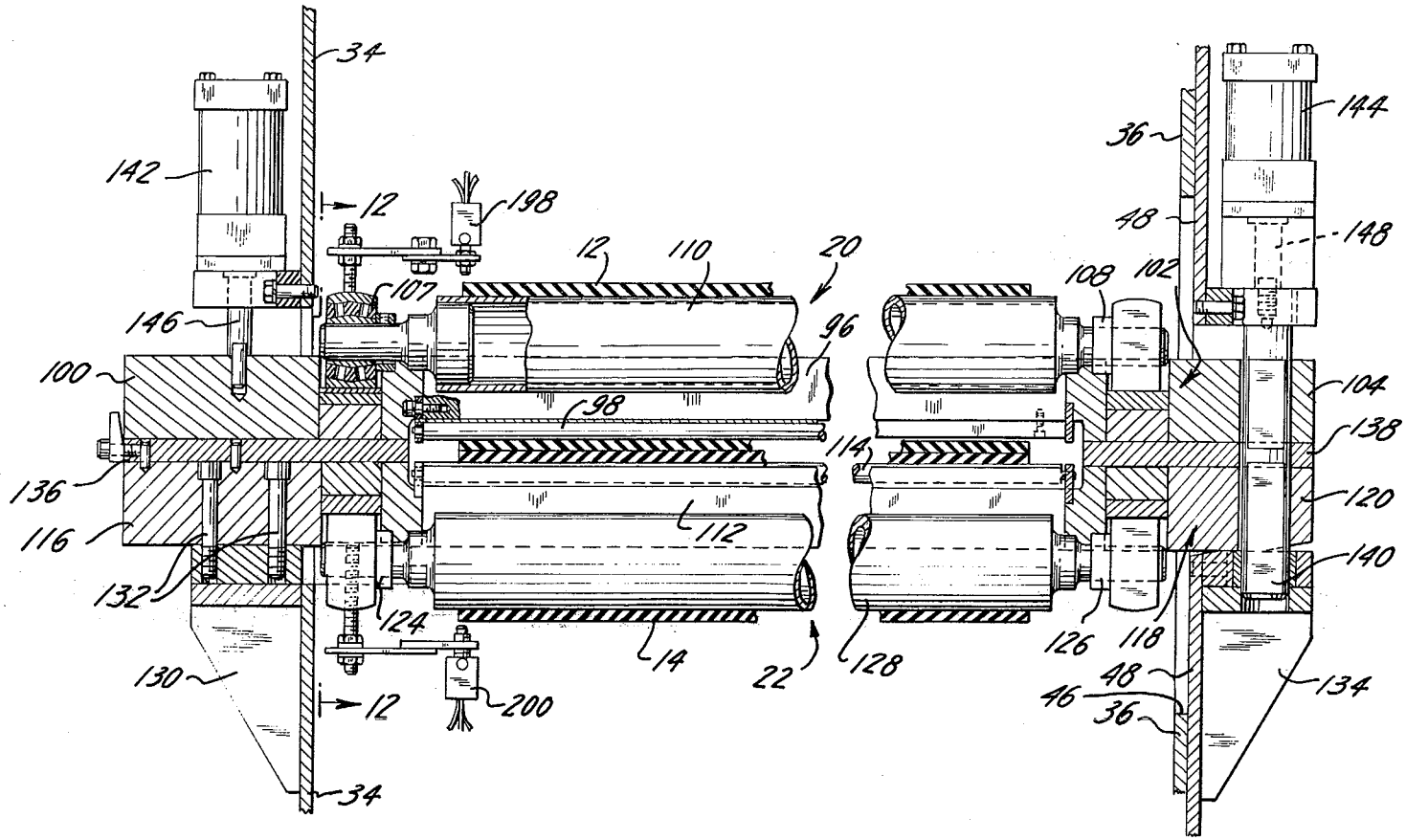
FIG. 4 is an elevation, partly in section, of a portion of the apparatus shown in FIG. 2 and taken along the lines 4—4 thereof.

As best seen in FIG. 4, end block 116 of the lower idler roller assembly 22 is firmly secured to a second support bracket 130 carried by side wall 34 by means of screw-threaded fasteners 132. The bifurcated end block 118 of lower idler roller assembly 22 is supported on a shaft 134 secured to the door 48 hinged on side wall 36. The upper idler roller assembly 20 is supported above the lower idler roller assembly 22 by a pair of relatively thin spacer blocks 136 and 138 sandwiched between end blocks 116, 100 and bifurcated end blocks 118, 102, respectively. It should be noted that a guide pin 140 extends upwardly from shelf 134 between the bifurcated legs 120, 122 and 106, 104 of the end blocks 118 and 102, respectively, to properly align the right hand side (as viewed in FIG. 4) of the idler roller assemblies 20 and 22. A pair of hydraulically operated cylinders 142 and 144 are secured on the side wall 34 and door 48, respectively. Their pistons 146 and 148 are connected to end block 100 and bifurcated end block 102, respectively, such that when desired, the entire upper idler roller assembly 20 can be lifted.

When it is desired to remove the blankets 12 and 14, in addition to performing the steps previously described with respect to the drive rollers 16 and 18, the following additional steps are performed. First, the hydraulic cylinders 142 and 144 are operated to lift the upper idler roller assembly 20. Thereafter, the relatively thin spacers 136 and 138 are removed and a substantially thicker spacer 150 (see FIG. 11) is placed between the end blocks 100 and 116. Thereafter, a collar 152 is placed about the assembly comprising the end blocks 100, 116 and the spacer 150 sandwiched therebetween. Thereafter, the door 48 (together with the cylinder 144 and the shelf 134 carrying the pin 140) can be pivoted to its open position illustrated in FIG. 15 to expose the cantilevered ends of the idler roller assemblies 20 and 22 in their separated condition. Of course, and as explained previously, the drive rollers 16 and 18 will also be separated and cantilevered at this time, whereby the blankets 12 and 14 may be easily slipped off the exposed ends of these various assemblies.

Figure 7:
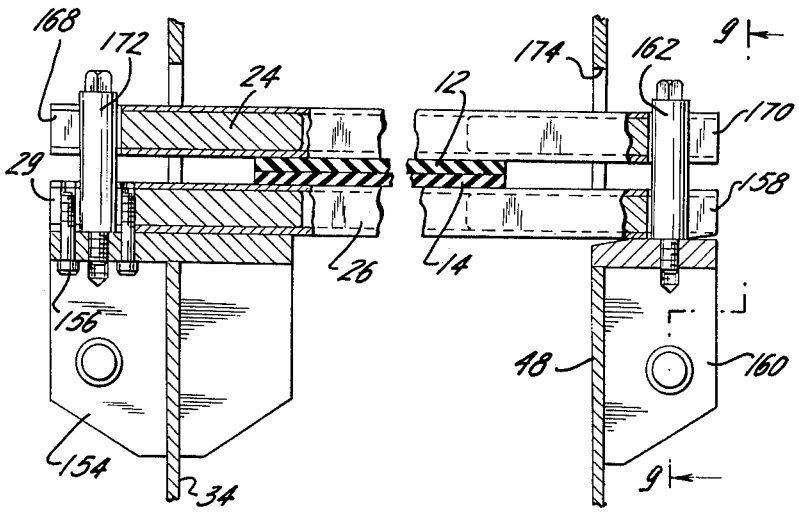
FIG. 7 is a front elevation, partly in section, of a portion of the apparatus shown in FIG. 3 and taken along the lines 7—7 thereof, it being noted that FIG. 7 has been broken along the center thereof to reduce the size of the Figure.
Figure 9:
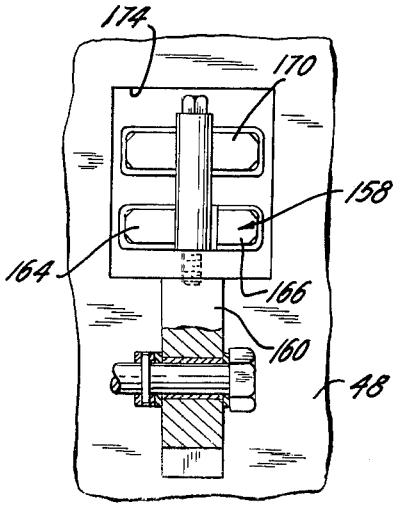
FIG. 9 is a side elevation, partly in section, of the apparatus shown in FIG. 7 and taken along the lines 9—9 thereof.

Considering FIGS. 7 through 9, it will be seen that the lower guide bar 26 is rigidly secured at one end 29 thereof to a third support bracket 154, secured to side wall 34. Screw-threaded fasteners 156 are employed to join the third support bracket 154 and the end 29 of guide bar 26. The opposite end 158 of guide bar 26 rests on its support shelf 160 secured to door 48. End 158 is bifurcated and a guide pin 162 secured to the shelf 160 passes between the legs 164 and 166 thereof. Upper guide bar 24 is bifurcated at both ends 168 and 170 and merely rests on lower guide bar 26 sandwiching the blankets 12 and 14 therebetween. A guide pin 172 secured to the support bracket 154 and the aforementioned guide pin 162 pass between the bifurcated legs of the ends 168 and 170 of guide bar 24 to properly align guide bar 24 with respect to guide bar 26.

When it is desired to remove the blankets 12 and 14, in addition to performing all of the operations previously described, the operator also removes the guide pin 162 from the support shelf 160 secured to the door 48. Thereafter, the upper guide bar 24 can be physically slid out of the opening 174 provided in the door 48. Thereafter, when the door 48 is opened as described previously, the remaining guide bar 26 will remain cantilevered with respect to the side wall 34. This can also be viewed in FIG. 15.

Figure 15:
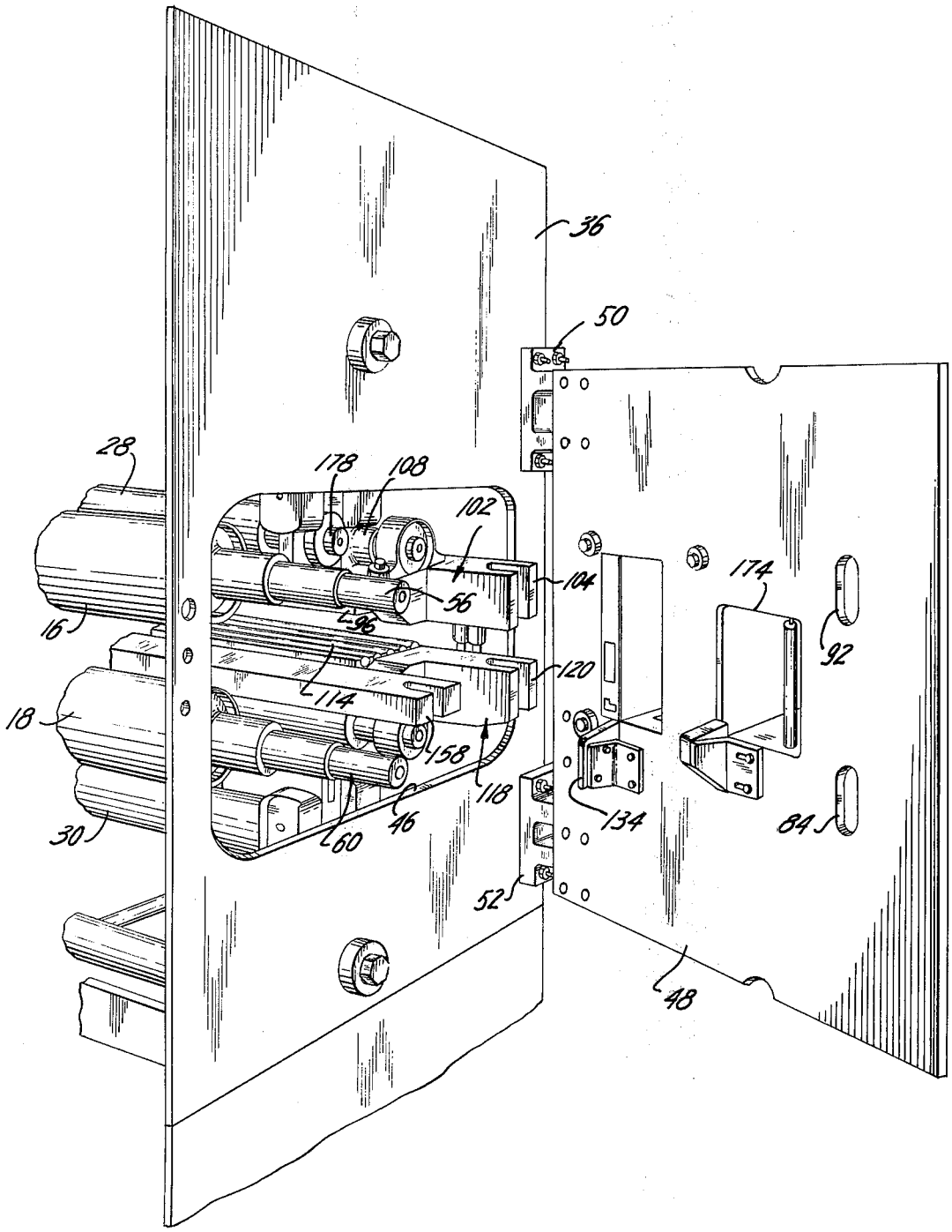
FIG. 15 is a perspective view of the left side of the apparatus of the instant invention with the special purpose door thereof shown in its open position to reveal the cantilevered ends of the blanket support elements.

Considering all of the previous description in conjunction with FIG. 1, it should now be appreciated that the instant invention makes possible a cantilevering of the drive rollers 16 and 18, the idler roller assemblies 20 and 22 and the lower guide bar 26 once the door 48 is moved to its open position illustrated in FIG. 15. In addition, the drive rollers 16 and 18 have been separated as have the idler roller assemblies 20 and 22 as compared to their normal operating positions. Thus, the blankets 12 and 14 can be easily slid off the free ends of these cantilevered elements and quickly and easily replaced. Of course, when all of the aforedescribed steps are performed in reverse such that the door 48 is closed and the various elements returned to their initial positions, all of the supporting and guiding assemblies will be properly and strongly supported between the two side walls of the frame to facilitate normal operation.

Turning to FIG. 6, it will be seen that the first tension roller 28 terminates in reduced diameter portions 176 and 178. End portion 178 is journaled for rotation in bearing 180 carried at the lower end of piston 182 of hydraulic cylinder 184 carried on the inner surface of side wall 36. In like fashion, end 176 of tension roller 28 is journaled for rotation in bearing 186 carried on the lower end of piston 188 of hydraulic cylinder 190. However, as can also be seen in FIG. 10, the entire cylinder 190 and piston 188 is carried within a carriage 192 rotatably carried with respect to side wall 34 about an axis established by shaft 194. The other side of carriage 192 has an opening 193 which freely receives a screw shaft 194'. A conventional fluid operated rotary motor 196 permits the carriage 192 to be selectively rotated with shaft 194, thereby permitting displacement of the end 176 of tension roller 28 in and out of the paper upon which FIG. 6 is drawn with respect to the opposite end 178. End 178 of tension roller 28 is journaled in a bearing 180 which is a self-aligning bearing and allows end 176 sufficient play into and out of the paper about 15° in either direction. In this manner, end 176 of tension roller 28 can be displaced to properly center blanket 12.

With reference to FIG. 4, a conventional fluidic sensor 198 which emits a jet stream of air senses whenever the blanket 12 deviates laterally from its centered position with respect to the side walls 34 and 36. Depending upon whether the blanket moves too far to the left or right in FIG. 4, the sensor 198 controls the rotary motor 196 of FIG. 6 to rotate the entire carriage 192 and, hence, the end 176 of the tension roller 28 in the appropriate direction to cause the blanket 12 to return toward its properly centered position. Duplicate structure is provided for the tension roller 30 and cooperates with sensor 200 in FIG. 4 to laterally move the left most end (as viewed in FIG. 6) of the tension roller 30 to continually center the blanket 14. Of course, hydraulic cylinders 190 and 184 (and the corresponding cylinders for tension roller 30) are employed to raise or lower the tension rollers 28 and/or 30 and thereby impart a selected tension on the blankets 12 and 14. Thus, the novel tension rollers 28 and 30 of the instant invention perform the dual function of achieving the desired tension and, at the same time, centering the blankets 28 and 30.

Although this invention has been described with respect to a preferred embodiment thereof, it should be understood that many variations and modifications will now be obvious to those skilled in the art, and it is preferred, therefore, that the scope of the invention be limited, now by the specific disclosure herein, only by the appended claims.

What is claimed is:

1. An apparatus for longitudinally compressing material, said apparatus comprising:

a frame, said frame including first and second spaced apart side walls;

first and second drive rollers supported between said side walls;

first and second idler roller assemblies supported between said side walls;

first endless belt means passing around said first drive roller and said first idler roller assembly;

second endless belt means passing around said second drive roller and said second idler roller assembly to define a path of travel for said material between said first and second endless belt means;

drive means for rotating said drive rollers whereby said first and second endless belt means will be moved with respect to the material passing therebetween, the material being longitudinally compressed in transit during said path of travel between said first and second endless belt means;

said second side wall having an opening therethrough and closure means movable between a closed and open position with respect to said opening, said closure means supporting one end of said first and second drive rollers and first and second idler roller assemblies when said closure means is in its closed position;

means for supporting said first and second drive rollers and said first and second idler roller assemblies in a cantilever arrangement on said first wall when said closure means is moved to said open position whereby said first and second endless belt means may be removed.

2. The apparatus of claim 1, and further including first tension roller means engaging said first endless belt means;

second tension roller means engaging said second endless belt means;

first support means carried on the inner surface of said second side wall for adjustably carrying one end of said first tension roller means; and second support means rotatably carried on the inner surface of said first side wall for adjustably carrying the other end of said first tension roller means.

3. The apparatus of claim 2, and further including motive means for selectively rotating said second support means.

4. The apparatus of claim 3, and further including third support means carried on the inner surface of said second side wall for adjustably carrying one end of said second tension roller means; and fourth support means rotatably carried on the inner surface of said first side wall for adjustably carrying the other end of said second tension roller means.

5. The apparatus of claim 4, and further including motive means for selectively rotating said fourth support means.

6. The apparatus of claim 3 wherein said second support means comprises drive means rotatably secured to said inner surface of said first side wall;

driven means, one end of which is driven by said drive means and one end of which is connected to said other end of said first tension roller means; and wherein said motive means comprises a fluid operated rotary motor.

7. The apparatus of claim 6, and further including third support means carried on the inner surface of said second side wall for adjustably carrying one end of said second tension roller means; and fourth support means rotatably carried on the inner surface of said first side wall for adjustably carrying the other end of said second tension roller means; and further including motive means for selectively rotating said fourth support means; and wherein said motive means comprises a fluid operated rotary motor.

8. The apparatus of claim 1 wherein said closure means includes first and second openings therein; and further including first and second bearings removably carried on said closure means about said first and second openings for rotatably supporting said first and second drive rollers when said closure means is maintained in its said closed position.

9. The apparatus of claim 8 wherein said first opening is enlarged in an upward direction and said second opening is enlarged in a downward direction in order to accommodate upward and downward movement of said first and second drive rollers, respectively, when said first and second bearings are removed from said closure means; and further including a first support bracket extending outwardly from said first side wall; said first side wall and said first support bracket providing two points of support for cantilevering said second drive roller when said second bearing is removed; and further including connecting means for selectively providing a second point of support for cantilevering said first drive roller when said first bearing is removed.

10. The apparatus of claim 9 wherein said connecting means comprises hook means of preselected length for selectively hooking said first drive roller to said second drive roller.

11. The apparatus of claim 8, and further including first tension roller means engaging said first endless belt means;

second tension roller means engaging said second endless belt means;

first support means carried on the inner surface of said first side wall for adjustably carrying one end of said first tension roller means; and second support means rotatably carried on the inner surface of said second side wall for adjustably carrying the other end of said first tension roller means.

12. The apparatus of claim 8 wherein said first and second idler roller assemblies each include
a wedge-shaped bar;
a plurality of rollers carried by and below said wedge-shaped bar; and
a main idler roller carried by and above said wedge-shaped bar.

13. The apparatus of claim 8 and further including first and second guide bars supported between said first and second side walls and positioned in guiding relationship within said first and second endless belt means, respectively; means for supporting at least said second guide bar in a cantilever arrangement with respect to said first side wall when said closure means is moved to its open position.

14. The apparatus of claim 13 and further including means for removably carrying said first guide bar with respect to said second guide bar so that said first guide bar can be removed from said second guide bar when said closure means is moved to its open position.

15. The apparatus of claim 8 wherein said closure means includes a first support shelf for supporting said second idler roller assembly when said closure means is in its closed position; and said first side wall includes a second support bracket for supporting said second idler roller assembly.

16. The assembly of claim 15 and further including:
spacer means of predetermined thickness removably positioned between first and second end portions of said first and second idler roller assemblies for establishing a spacing between said first and second idler roller assemblies when said idler roller assemblies are supported by said first support shelf and said second support bracket with said closure means in its said closed position; and
clamping means for cantilevering said first end portions of said first and second idler roller assemblies with respect to said second support bracket.

17. The apparatus of claim 16 and further including activating means for lifting said first idler roller assembly with respect to said second idler roller assembly; whereby said spacer means may be removed.

18. The apparatus of claim 15 and further including first and second guide bars supported between said first and second side walls and positioned in guiding relationship within said first and second endless belt means, respectively; means for supporting at least said second guide bar in a cantilever arrangement with respect to said first side wall when said closure means is moved to its open position.

19. The apparatus of claim 18 and further including means for removably carrying said first guide bar with respect to said second guide bar so that said first guide bar can be removed from said second guide bar when said closure means is moved to its open position.

20. The apparatus of claim 1 wherein said first and second idler roller assemblies each include
a wedge-shaped bar;
a plurality of rollers carried by and below said wedge-shaped bar; and
a main idler roller carried by and above said wedge-shaped bar.

21. The apparatus of claim 1 wherein said closure means includes a first support shelf for supporting said second idler roller assembly when said closure means is in its closed position; and said first side wall includes a second support bracket for supporting said second idler roller assembly.

22. The apparatus of claim 21, and further including:
spacer means of predetermined thickness removably positioned between first and second end portions of said first and second idler roller assemblies for establishing a spacing between said first and second idler roller assemblies when said idler roller assemblies are supported by said first support shelf and said second support bracket with said closure means in its said closed position; and
clamping means for cantilevering said first end portions of said first and second idler roller assemblies with respect to said second support bracket.

23. The apparatus of claim 22 and further including activating means for lifting said first idler roller assembly with respect to said second idler roller assembly; whereby said spacer means may be removed.

24. The apparatus of claim 21 wherein said first and second idler roller assemblies each include
a wedge-shaped bar;
a plurality of rollers carried by and below said wedge-shaped bar; and
a main idler roller carried by and above said wedge-shaped bar.

25. The apparatus of claim 1 and further including first and second guide bars supported between said first and second side walls and positioned in guiding relationship within said first and second endless belt means, respectively; means for supporting at least said second guide bar in a cantilever arrangement with respect to said first side wall when said closure means is moved to its open position.

26. The apparatus of claim 25 and further including means for removably carrying said first guide bar with respect to said second guide bar so that said first guide bar can be removed from said second guide bar when said closure means is moved to its open position.

27. The apparatus of claim 25 and further including
first tension roller means engaging said first endless belt means;
second tension roller means engaging said second endless belt means;
first support means carried on the inner surface of said second side wall for adjustably carrying one end of said first tension roller means; and
second support means rotatably carried on the inner surface of said first side wall for adjustably carrying the other end of said first tension roller means.

28. An apparatus for longitudinally compressing material; said apparatus comprising:
a frame, said frame including first and second spaced apart side walls;
first and second drive rollers supported between said side walls;
first and second idler roller assemblies supported between said side walls;
first endless belt means passing around said first drive roller and said first idler roller assembly;
second endless belt means passing around said second drive roller and said second idler roller assembly to define a path of travel for said material between said first and second endless belt means;
drive means for rotating said drive rollers whereby said first and second endless belt means will be moved with respect to the material passing therebetween, the material being longitudinally compressed in transit during said path of travel between said first and second endless belt means;

first tension roller means engaging said first endless belt means;

second tension roller means engaging said second endless belt means;

first support means carried on the inner surface of said second side wall for adjustably carrying one end of said first tension roller means to permit selective vertical movement thereof; and second support means rotatably carried on the inner surface of said first side wall for adjustably carrying the other end of said first tension roller means so as to permit both rotational and vertical movement thereof.

29. The apparatus of claim 28 and further including third support means carried on the inner surface of said second side wall for adjustably carrying one end of said second tension roller means to permit selective vertical movement thereof; and fourth support means rotatably carried on the inner surface of said first side wall for adjustably carrying the other end of said second tension roller means so as to permit both rotational and vertical movement thereof.

30. The apparatus of claim 29 and further including motive means for selectively rotating said fourth support means.

31. The apparatus of claim 30 wherein said motive means comprises a fluid operated rotary motor.

32. The apparatus of claim 28 wherein said first support means comprises drive means secured to said inner surface of said second side wall and driven means, one end of which is driven by said drive means and one end of which is connected to said one end of said first tension roller means.

33. The apparatus of claim 32 wherein said drive means comprises a fluid operative cylinder and said driven means comprises a cooperating piston.

34. The apparatus of claim 32 wherein said second support means comprises drive means rotatably secured to said inner surface of said first side wall;

driven means, one end of which is driven by said drive means and one end of which is connected to said other end of said first tension roller means; and motive means for selectively rotating said second support means.

35. The apparatus of claim 34 wherein said drive means comprises a fluid operative cylinder and said driven means comprises a cooperating piston.

36. The apparatus of claim 28 and further including motive means for selectively rotating said second support means.

37. The apparatus of claim 36 wherein said motive means comprises a fluid operated rotary motor.

* * * * *